United States Patent [19]

Arnold et al.

[11] Patent Number: 4,998,982

[45] Date of Patent: Mar. 12, 1991

[54] METAL LADDER CONSTRUCTION WITH REINFORCED SIDE RAILS

[76] Inventors: William F. Arnold; Bill M. Arnold, both of 1405 Waterless Dr., Fayetteville, N.C. 28306

[21] Appl. No.: 285,405

[22] Filed: Dec. 16, 1988

[51] Int. Cl.[5] ..... E06C 1/383; E06C 7/08

[52] U.S. Cl. ..... 182/159; 182/107; 182/214; 182/219

[58] Field of Search ..... 182/159, 160, 214, 111, 182/194, 219, 217, 209, 207, 194, 219, 159; 52/731

[56] References Cited

U.S. PATENT DOCUMENTS

| | | | |
|---|---|---|---|
| 195,440 | 9/1877 | Boyington | 182/210 |
| 816,914 | 4/1906 | Hinckley | 182/111 |
| 1,656,871 | 1/1928 | Schnitzer | 52/731 |
| 2,776,080 | 1/1957 | Hopfeld | 182/219 |
| 3,722,622 | 3/1973 | Lauring | 182/159 |
| 3,773,143 | 11/1973 | Prete | 182/214 |

FOREIGN PATENT DOCUMENTS

| | | | |
|---|---|---|---|
| 323411 | 4/1903 | France | 182/160 |

*Primary Examiner*—Reinaldo P. Machado
*Attorney, Agent, or Firm*—Rhodes, Coats & Bennett

[57] ABSTRACT

A metal construction for a ladder includes two spaced apart side rails and a plurality of rungs attached at their ends to the side rails. The side rails each include a generally rectangular side rail tube having angularly disposed reinforcing webs integrally formed within the tube. A plurality of weight reducing apertures are formed in the sidewalls of the tube and are longitudinally spaced at predetermined intervals. The rungs include a tube with an integral reinforcing web extending parallel to the sidewalls of the tube. A portion of the sidewalls of the ladder rung tube are removed by milled slots. The rungs are pivotally attached to the side rails to allow the ladder to be collapsed down to a folded condition.

18 Claims, 6 Drawing Sheets

METAL LADDER CONSTRUCTION WITH REINFORCED SIDE RAILS

FIELD OF THE INVENTION

The present invention relates generally to the design and construction of ladders and more particularly to the design and construction lightweight, collapsible ladders.

BACKGROUND OF THE INVENTION

Ladders designed for use by military personnel in combat assaults must meet stringent design criteria. The ladders must be relatively light and, at the same time, withstand relatively high loads. These two competing concerns generally result in compromise solutions where strength is traded for a reduction in weight. Another major concern with the design of ladders for military and law enforcement personnel is that the ladder be collapsible into a compact condition. While collapsible ladders are known, they are generally unsuited for military purpose which require that the ladder be rapidly deployable.

SUMMARY AND OBJECTS OF THE INVENTION

The present invention overcomes the aforementioned problems with the prior art by reinforcing the side rails and rungs of the ladder so that a series of weight-reducing apertures and slots can be formed therein. The side rails and rungs are formed from rectangular tubes having longitudinally extending reinforcing webs integrally formed inside the tube. The reinforcing webs of the side rails and rungs function similar to a truss so that apertures and slots formed in the side rails to reduce the weight thereof do not adversely effect the load carrying capacity of the ladder.

In another aspect of the invention, the ladder includes two collapsing sections which can be rapidly assembled and disassembled. To assemble the ladder, the present invention utilizes a pair of first end brackets, a pair of second end brackets, a pair of locking bushings, and a plurality of push pins.

The first and second end brackets each include a sleeve portion which slides over the side rail of the first ladder section and secured there by a push pin. The first end bracket, which is secured to the first ladder section, includes a retaining hook portion that extends from the sleeve portion around the side rail of the second ladder section The second end bracket includes a connecting arm portion that extends generally downwardly from the sleeve portion. The cylindrical locking bushings are insertable into the apertures of the first ladder section so that the axial bore formed therein aligns with the locking hole in the connecting arm portion of the second end bracket. A push pin is insertable through the axial bore in the locking bushing The end of the push pin extends from the locking bushing and through the locking hole in the connecting arm portion of the second end bracket. The push pins can be easily inserted or removed and thus facilitate rapid assembly and disassembly.

From the foregoing, it is apparent that the primary object the present invention is to provide a collapsible ladder that can be rapidly deployed by military and law enforcement personnel. To achieve this goal, the ladder is designed with a minimal number of components which can be rapidly assembled and disassembled.

Another object of the present invention is to provide a rapidly deployable ladder for use by military and law enforcement personnel that is lightweight yet capable of withstanding heavy loads. This is accomplished by using side rails and rungs constructed of a lightweight metal which are reinforced to reduce flexure of the ladder during loading Due to the reinforcing of the ladder, a substantial portion of the side rails and ladder rungs can be removed to reduce the weight of the ladder.

Another object of the present invention is to provide a ladder for use by military and law enforcement personnel having a high degree of flexibility. This object is accomplished by the present invention by providing components which can be selected and assembled as the circumstances warrant.

Other objects and advantages of the present invention will become apparent and obvious from a study of the following description and the accompanying drawings which are merely illustrative of such invention.

DESCRIPTION OF THE INVENTION

Figure 1:
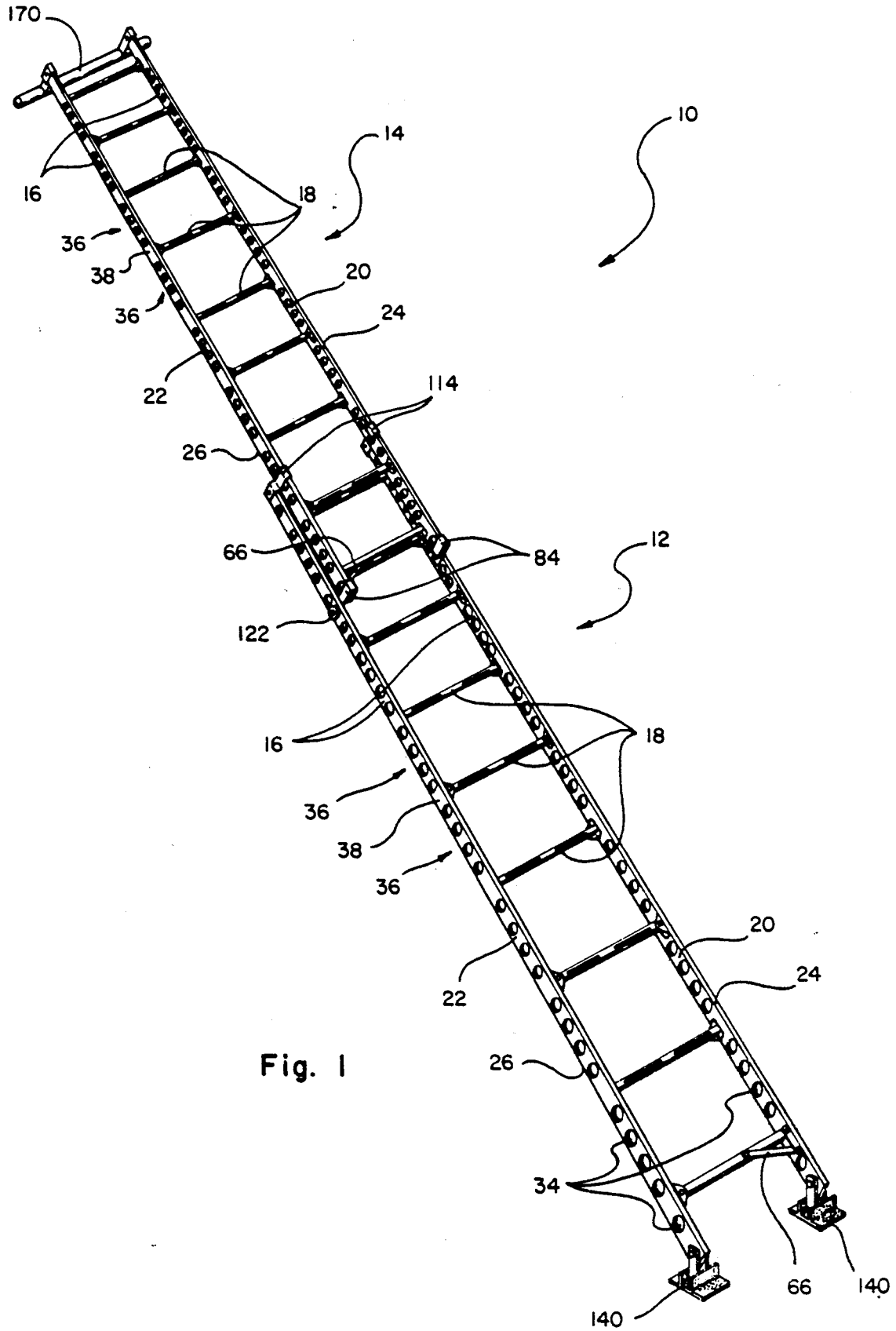
FIG. 1 is a perspective view of the assembled ladder.

Referring initially to FIG. 1, the lightweight, collapsible ladder of the present invention is shown therein and indicated generally by the numeral 10 In the preferred embodiment of the invention, the collapsible ladder 10 comprises two ladder sections, 12 and 14, which can be readily assembled and disassembled to form an extensible ladder. When assembled, the first and second ladder sections, 12 and 14, are disposed adjacent one another with ends overlapping.

The first and second ladder sections, 12 and 14, each include a pair of spaced apart side rails 16 interconnected by a plurality of rungs 18. The side rails 16 and rungs 18 are constructed preferably from an aluminum alloy.

The side rails 16 comprise a generally rectangular tube having an inner side wall 20, an outer side wall 22, a top wall 24 and a bottom wall 26. (See FIG. 2). Securing holes 21 are formed in both ends of the side rail tubes. A pair of longitudinally extending reinforcing webs 28 are integrally formed inside each side rail tube. The reinforcing webs 28 are angularly disposed so as to form two triangular cavities 30 separated by a trapezoidal cavity 32. The reinforcing webs 28 reduce the flexure of the side rail 16 during loading periods in both the longitudinal and lateral directions. By reason of the reinforcing webs 28, it is possible to form a series of apertures 34 in the inner side walls 20 and outer side walls 22 to reduce the weight of the ladder without significantly effecting the load carrying capacity of the ladder 10. The apertures 34 formed in the inner side wall 20 of the side rail are axially aligned with a corresponding apertures 34 in the outer side wall 22. In general, the apertures 34 arc arranged in groups 36 of four equally spaced apertures 34 with a space 38 between each group 36 to provide space for attachment of the rungs 18 to the side rail 16.

The ladder rungs each comprise an essentially square tube having side walls 40, a top wall 42 and a bottom wall 44. A reinforcing web extends lengthwise through the tube and is disposed parallel to the side walls 40. Also, three triangular gripping elements 48 are integrally formed with the top wall 42 of the ladder rung tube and extend the full length thereof. To reduce the weight of the ladder rung 18, longitudinally extending slots 50 are formed in the side walls 40 of the ladder rung tubes.

Figure 2:
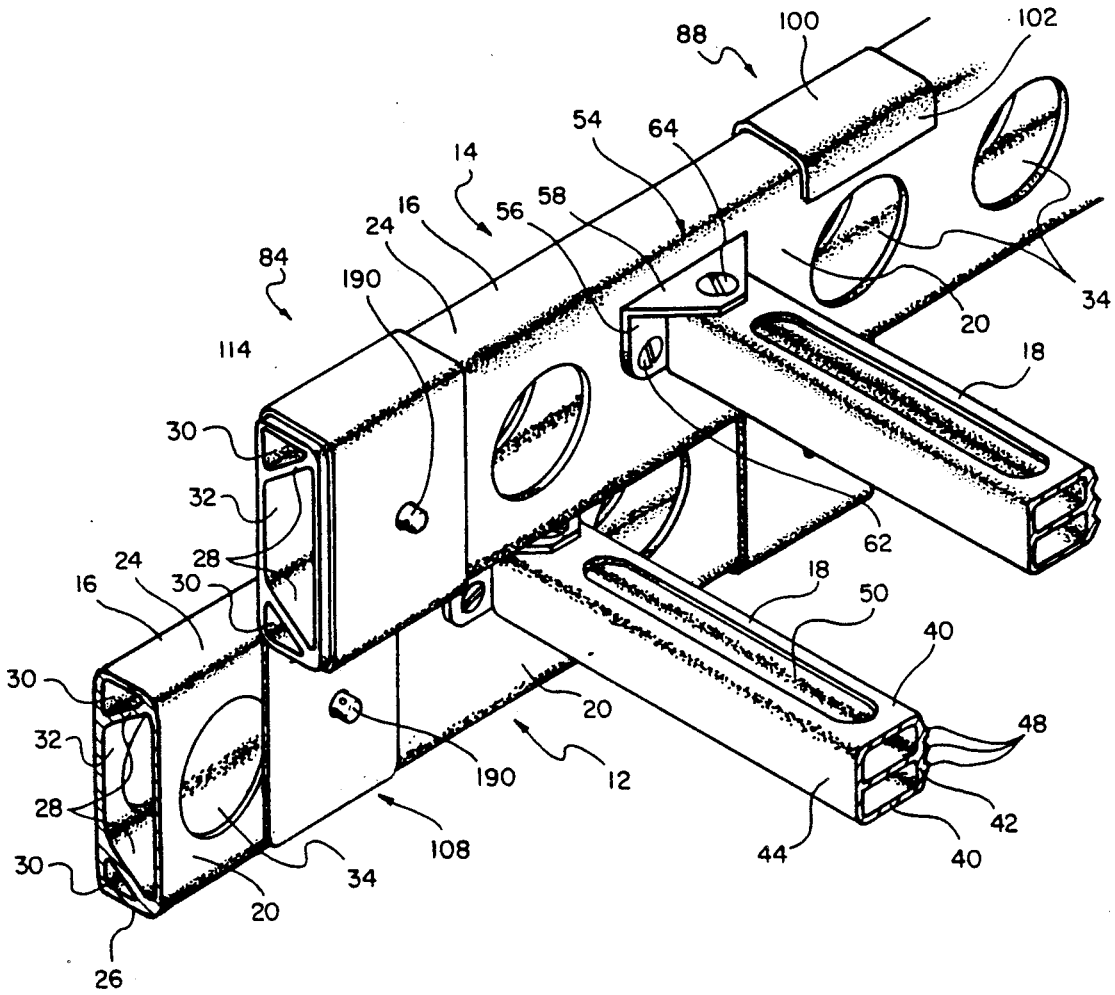
FIG. 2 is a detailed perspective of the assembled ladder from the inside thereof.
Figure 10:
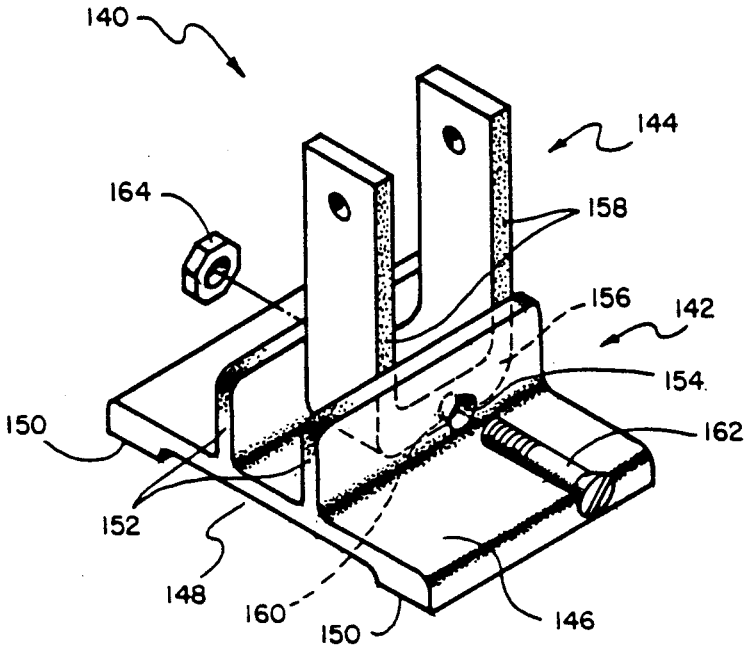
FIG. 10 is a perspective view of the foot assembly.
Figure 11:
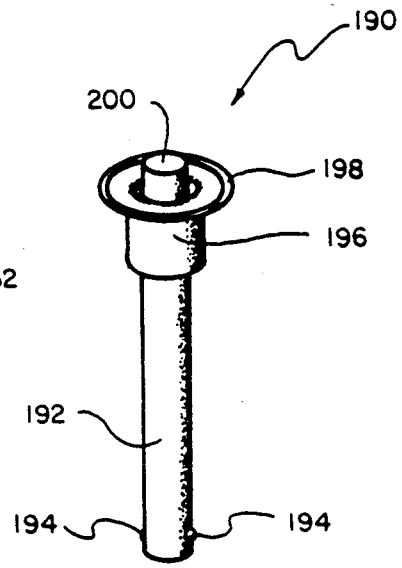
FIG. 11 is a perspective view of a conventional push pin used to assemble the components of the present invention.
Figure 13:
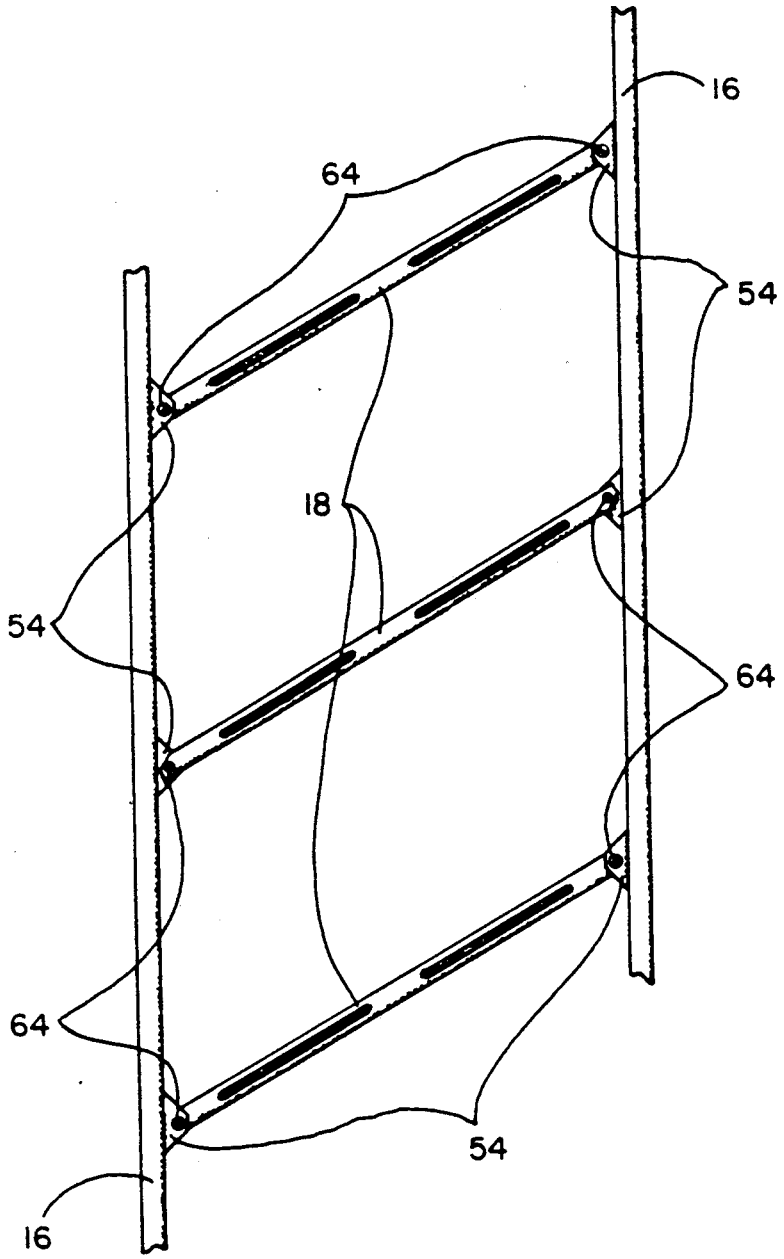
FIG. 13 is a partial plan view of a partially collapsed ladder.
Figure 14:
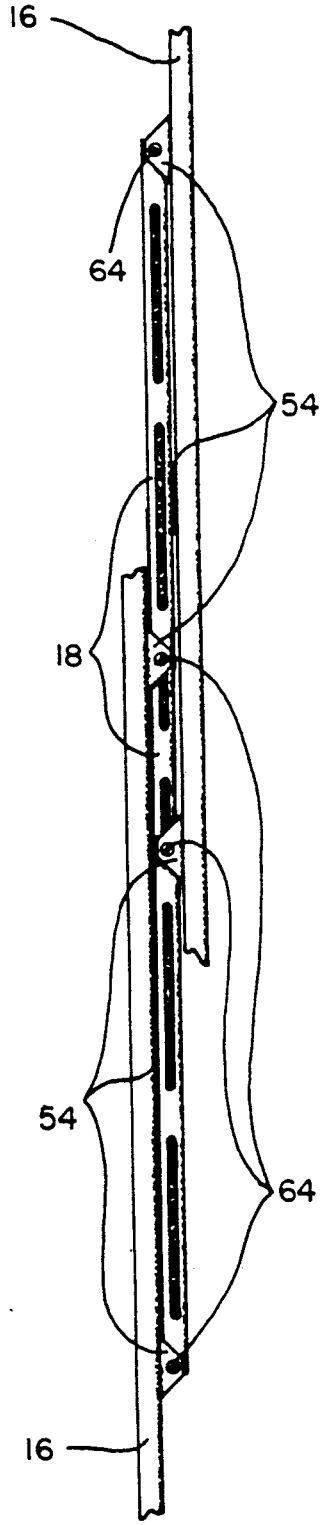
FIG. 14 is a partial plan view of a fully collapsed ladder.

The rungs 18 are attached at their end to the side rails 16 by rung brackets 54. As shown in FIG. 2, the rung bracket has a generally L-shaped configuration including a back 56 and a flange 58. The back 56 of the rung bracket 54 is secured to the inner side wall 20 of the side rails 16 by a conventional bolt 62. The ends of the rungs 18 are pivotally secured to the flange 58 so that each ladder section 12 and 14 can be collapsed into a folded condition as shown in FIGS. 10 and 11. Adjacent rungs 18 must be secured to the side rails 16 in different planes as best seen in FIG. 1 so that the ends of rungs 18 can overlap when the ladder 10 is collapsed into a folded condition.

Figure 15:
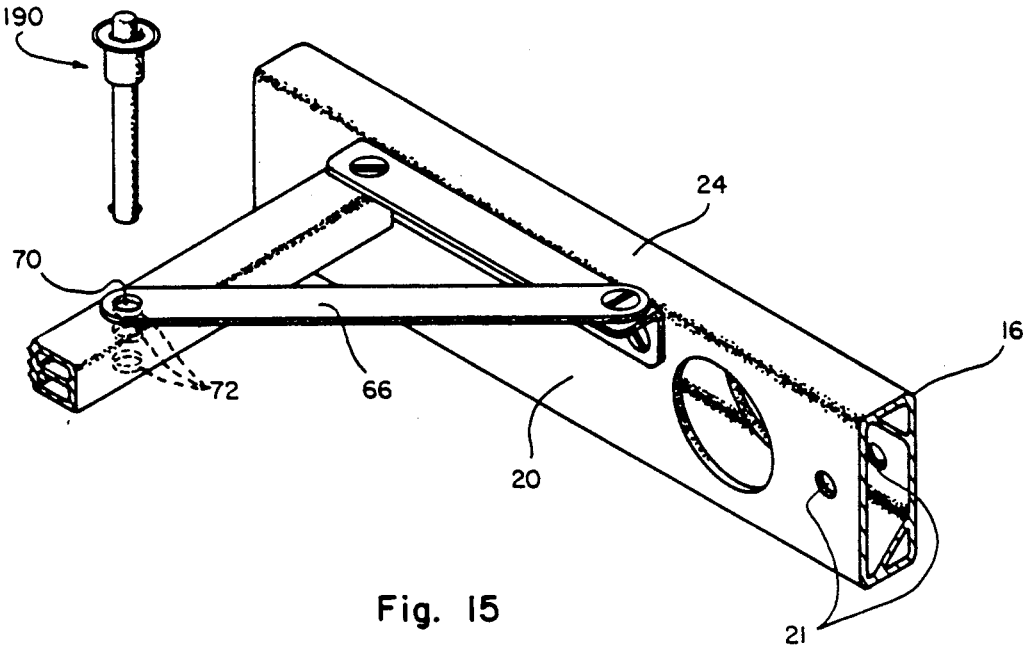
FIG. 15 is a partial perspective illustrating the locking bar.

During use, the ladder sections, 12 and 14, are held in an unfolded condition by a locking bar 66 which is pivotally attached at one end to the lowermost ladder rung brackets 54. (See FIG. 15). The opposite end of the locking bar 66 is provided with a locking hole 70 for securing the locking bar 66 to the lowermost rung 18. In the preferred embodiment, the locking bar 66 is secured by a push pin 190 which is inserted through locking hole 70 in the locking bar 66 and the corresponding holes 72 in the lowermost ladder rung 18.

The ladder sections 12 and 14 as described herein are approximately 12 feet in length The ladder sections 12 and 14 may be joined to form a ladder of up to 24 feet in length. To join the ladder sections 12 and 14, the present invention includes a pair of first end brackets 84, a pair of second end brackets 114 and a pair of locking bushings 122. The first end brackets 84 hold the first and second ladder sections together while permitting relative longitudinal movement therebetween. The second end brackets, in combination with the locking bushing 122, lock the first and second ladder sections to prevent relative longitudinal movement.

Figure 5:
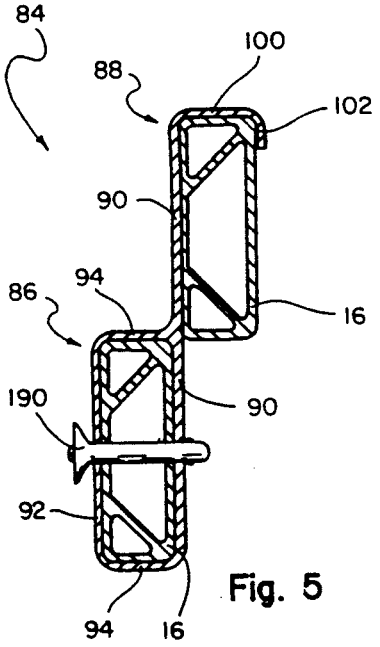
FIG. 5 is a section view of the assembled ladder illustrating the first end bracket.
Figure 4:
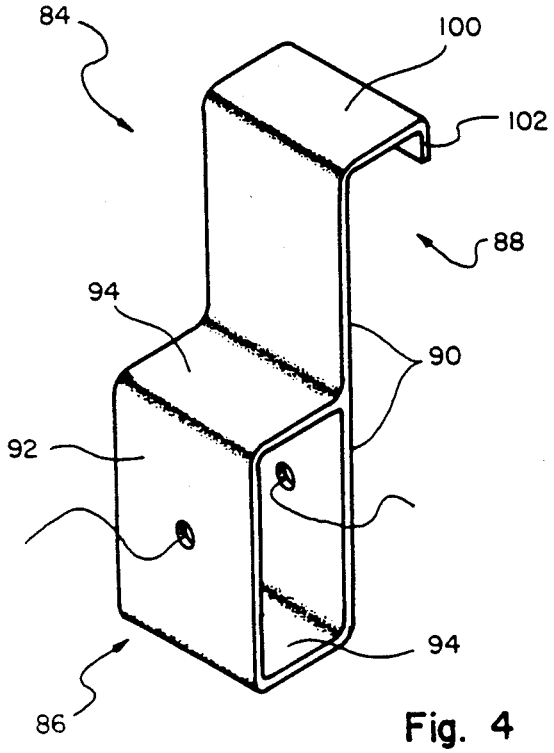
FIG. 4 is a perspective of the first end brackets.

The first end bracket, shown in FIGS. 4 and 5 includes a sleeve portion 86 and a retaining hook portion 88 which are integrally formed with one another, share a common wall 90. The sleeve portion 86 generally comprises a tube integrally formed on one side of the common wall 90 and includes a side wall 92 that is spaced from and extends parallel to the common wall 90, a top wall 94, and a bottom wall 96. The retaining hook portion includes a top retaining wall 100 extending perpendicularly from the common wall 90 and a side retaining wall 102 extending downwardly from the top retaining wall 100 parallel to the common wall 90. The sleeve portion 86 of the first end bracket 84 is adapted to slide over the end of the side rail tube 16 of the first ladder section 12 where it is secured by a push pin 190. The retaining hook portion 88 is adapted to extend over and around the side rail 16 of the second ladder section. Thus, the side rail 16 of the second ladder section 14 will be confined between the top retaining wall 100 and the ladder rungs 18 of the first ladder section as shown in FIGS. 2 and 5.

Figure 7:
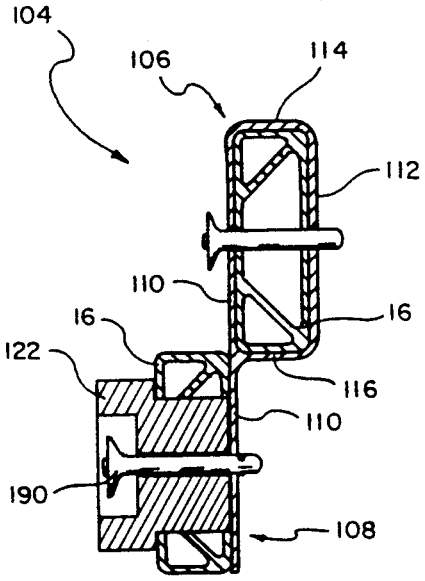
FIG. 7 is a section view of the assembled ladder illustrating the second end bracket.
Figure 6:
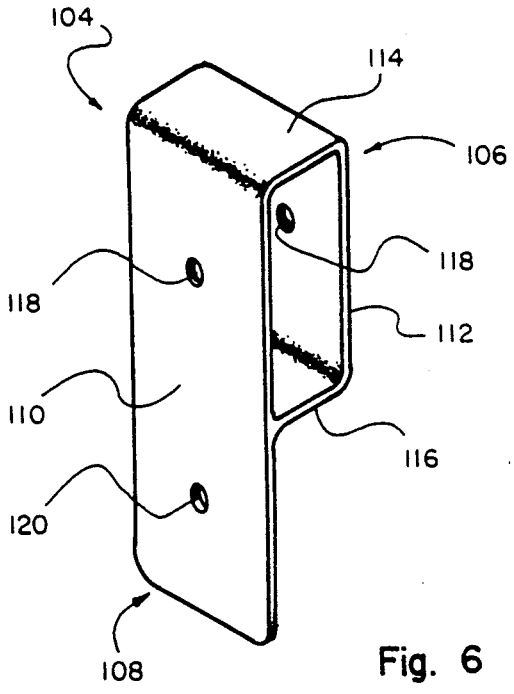
FIG. 6 is a perspective view of the second end brackets.

The second end brackets 104 are constructed similarly to the first end brackets and are illustrated in FIG. 6 and 7. The second end brackets 104 each include a sleeve portion 106 and a connecting arm portion 108, integrally formed with one another and including a common wall 110. The sleeve portion 106 includes, in addition to the common wall 110, a side wall 112 which is spaced from and extends parallel to the common wall 110, a top wall 114 and a bottom wall 116. Securing holes 118 are formed in the common wall 110 and side wall 112 and are axially aligned with one another. The connecting arm portion 108 comprises that portion of the common wall 110 that extends below the bottom wall 116 of the sleeve portion 106. A securing hole 120 is formed in the connecting arm portion of the common wall 110 in vertical alignment with the securing hole 118.

Figure 3:
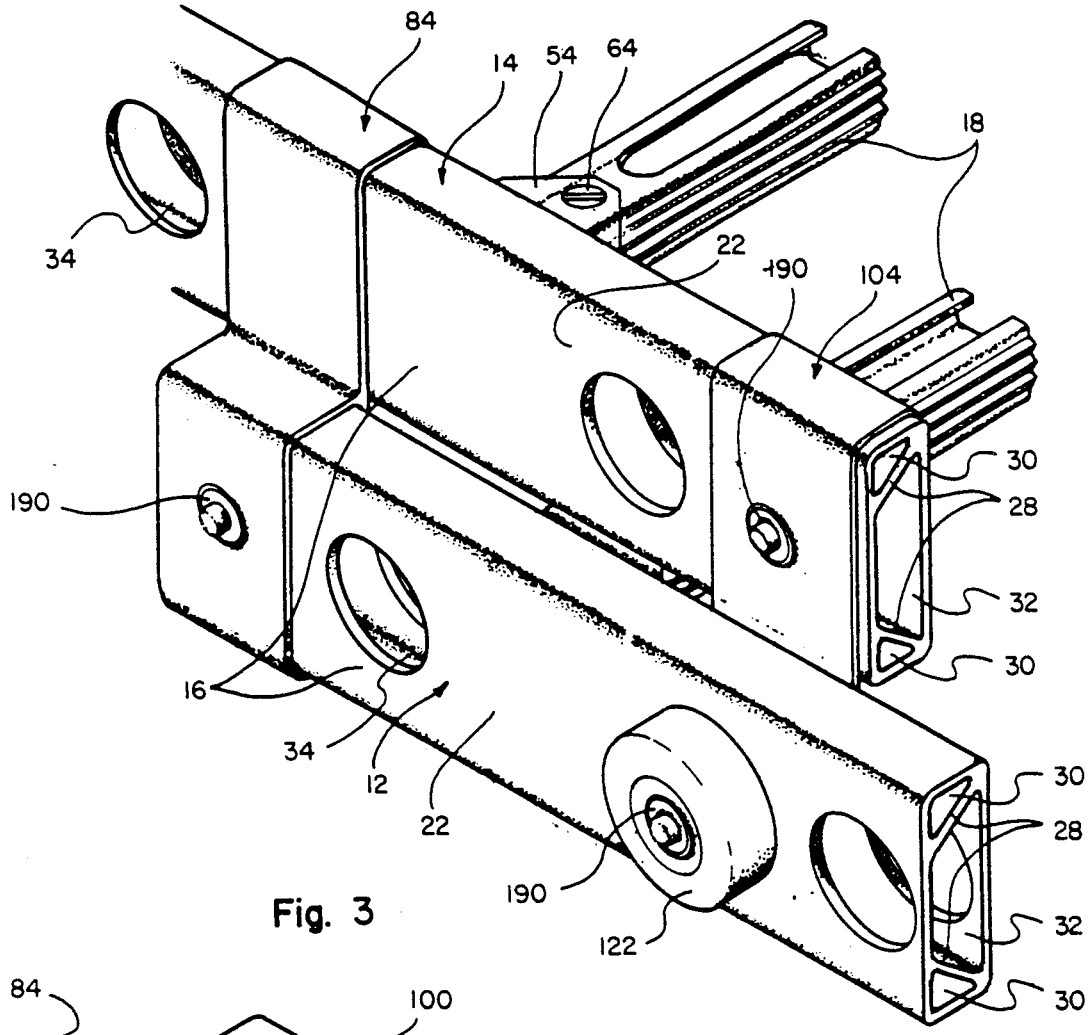
FIG. 3 is a detailed perspective showing a portion of the assembled ladder; from the outside thereof.
Figure 8:
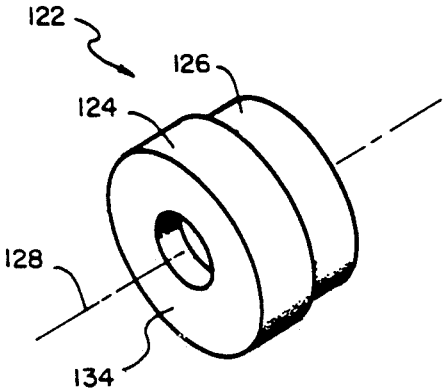
FIG. 8 is a perspective of the locking bushings.
Figure 9:
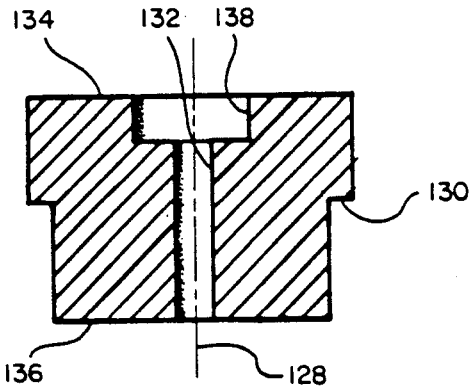
FIG. 9 is a section view of the locking bushing.

The sleeve portion 106 of the second end bracket 104 is adapted to slide over the end of the side rail 16 of the second ladder section 14. The connecting arm portion 108 extends downward from the sleeve portion, as shown in FIGS. 2 and 7 is disposed alongside the side rail 16 of the first ladder section 12. A push pin 190, the end of which is shown in FIG. 2, projects through the securing hole 120 in the connecting arm portion 108. The engagement of the push pin 190 with the connecting arm portion 108 prevents relative longitudinal movement between the first and second ladder sections The locking bushing 122, which is illustrated in FIGS. 8 and 9 includes an outer cylinder 124 and an inner cylinder 126 which are centered about the axis 128 of the locking bushing 122. The outer cylinder 124 and inner cylinder 126 are integrally formed, preferably from nylon or similar materials. The diameter of the inner cylinder 126 is smaller than the diameter of the outer cylinder 124 so that an abutment surface 130 is formed between the inner and outer cylinders. An axial bore 132 extends through the locking bushing 122 from the outer surface 134 to the inner surface 136. A counter bore 138 is formed in the outer surface 134 of the locking bushing 122 at the end of the axial bore 132. The locking bushing 122 is used to secure the connecting arm portion 108 of the second end bracket 104. This is accomplished by inserting a locking bushing into one of the apertures 34 in the side rail 16 as shown in FIG. 3 and 7. A push pin 190 is then inserted through the axial bore 132 until the end of the push pin projects through the hole in the connecting arm 104 as shown in FIG. 2.

In FIG. 10, a foot assembly 140 is shown for use in connection with the ladder 10 of the present invention.

The foot assembly includes a base portion 142 and a swivel connector 144. The base portion 142 includes a horizontally disposed base plate 146. A laterally extending recess 148 is formed in the underside of the base plate 146 so as to form a pair of feet 150 along the front and rear edges of the base plate 146. A pair of parallel flanges 152 extend upwardly from the base plate 146 to define a channel for receiving the swivel connector 144.

The swivel connector 144 comprises a generally U-shaped bracket having a connecting portion 156 and a pair of parallel legs 158. A swivel hole 160 extends through the connecting portion 156 of the swivel connector 144. The swivel connector 144 is inserted between the flanges 152 of the base portion 142 so that the swivel hole 156 aligns with the holes 154 in the flanges 152. A bolt 162 extends through the holes 154 and 160 in the base portion 142 and swivel connector 144 respectively The nut 164 threads onto the end of the bolt 162 to secure the base portion 142 and swivel connector 144 together. The swivel connector 144 is allowed to freely pivot about the bolt 164.

Figure 12:
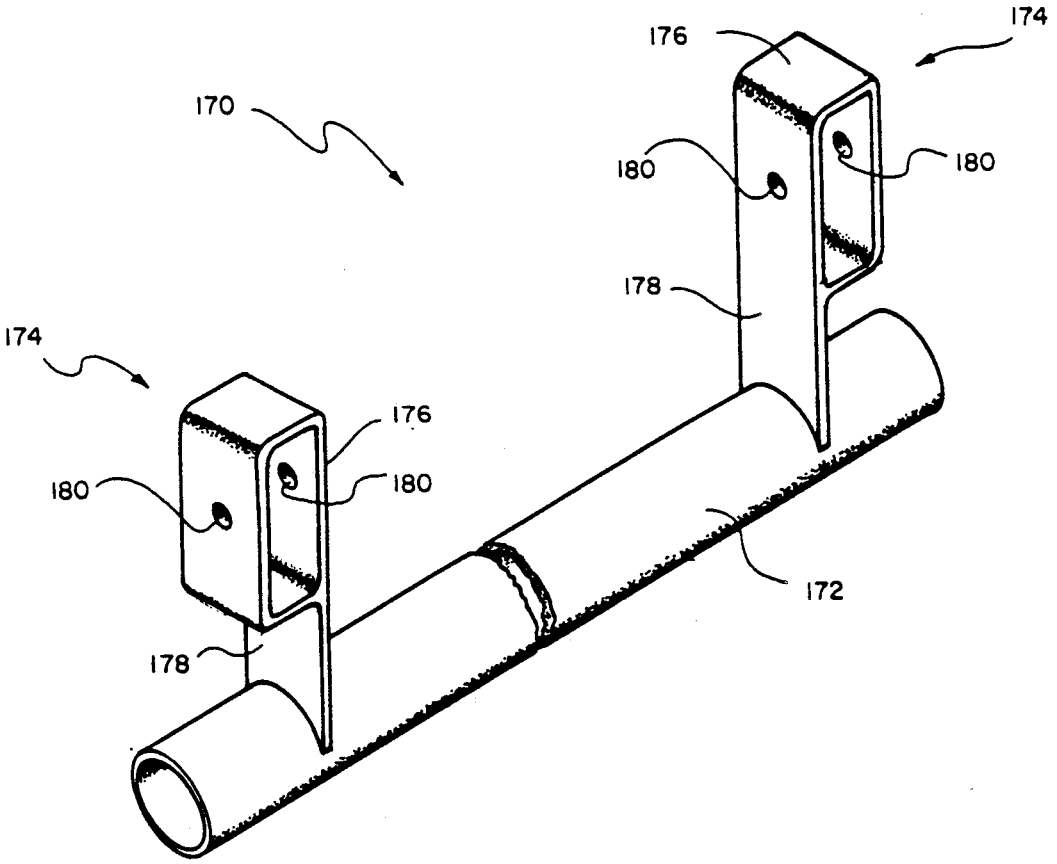
FIG. 12 is a perspective view of the contact bar assembly.

Referring now to FIG. 12, the contact bar assembly 170 is illustrated. The contact bar assembly includes a contact tube 172 and a pair of tube support brackets 174. The contact tube support brackets 174 are constructed almost identically as the second end bracket 104. The contact tube support bracket 174 includes a sleeve portion 176 and a connecting arm portion 178. The sleeve portion 176 is adapted to slide over the side rails 16 of the second ladder section, while the connecting arm portion 178 is welded to the contact tube 172. Securing holes 180 extend through the sleeve portion of the tube support bracket.

Most of the components of the ladder, with the exception of the locking bushings 122 are formed with an aluminum alloy by an extrusion process. Preferably, the alloy is a 6061 aluminum alloy which is tempered to T6. The 6061 alloy provides sufficient strength while being relatively lightweight.

The various components of the ladder 10 described herein are readily assembled to one another by means of conventional push pins 190. The push pin 190 generally includes a pin shaft 192 having two diametrically opposed apertures (not shown) formed in the lower end thereof. A pair of detent balls 194 are disposed within the pin shaft 192 and are urged outwardly through the apertures 194 by an actuating member (not shown) contained within the pin shaft 192. A cup-shaped flange cap 196 is secured to the end of the pin shaft 192 opposite the detent balls 194. The flange cap 196 includes a radially extending flange 198. A push button 200 is disposed within the cup-shaped flange cap 196. When the push button 200 is pressed, the actuating member is moved out of engagement with the detent balls 194 allowing them to recede into the pin shaft 192. When the push button is released, the actuating member again engages the detent balls 194 urging them outwardly.

The push pins 190 described herein are readily commercially available. Avibank manufactures push pins 190 found to be suitable for practicing the present invention. Avibank also manufactures cable ties which can be used to secure the push pins 190 to the components of the ladder so that they are not separated and lost.

In use, the individual ladder sections 12 and 14 will be hand carried to the point of deployment in a folded condition. The first and second end brackets 84 and 104, the locking bushings 122, the foot assemblies 140 and contact bar 170 can be conveniently carried in a small back pack or the like.

To assemble the ladder, the first and second ladder sections 12 and 14 are unfolded by racking the side rails 16. When the rungs are perpendicular to the side rails 16, the locking bar 66 is pivoted until the securing hole 70 of the locking bar 66 aligns with the securing hole 72 in the lower rung 18. The push pin 190 attached to the locking bar 66 is then inserted through the aligned holes 170 and 172.

Once the ladder sections 12 and 14 are unfolded and secured, the ends are overlapped as shown best in FIG. 1. The first end brackets 84 are then secured to the side rails 16 of the first ladder section 12. This is done by engaging the retaining hook portion 88 with the side rail 16 of the second ladder section 14 and sliding it until the sleeve portion 86 slides over the side rail 16 of the first ladder section 12. Once the securing holes 98 in the first end brackets align with the securing holes 21 in the side rail 16, a push pin 190 is inserted into the aligned holes to secure the bracket 84.

The second end brackets 104 are secured to the side rail 16 of the second ladder section 14 in the same manner. The sleeve portions 106 slide over the side rails with the connecting arm portion 108 extending downwardly therefrom. When the securing hole 118 of the second end bracket 104 is aligned with the securing hole 21 in the end of the side rail 16 of the second ladder section 14, a push pin is inserted into the aligned holes to secure the second end bracket 104.

At this stage in the assembly process, the first and second ladder sections 12 and 14 will freely slide relative to one another. This allows the ladder to be extended or retracted to the desired length. Once the desired length is obtained, the connecting arm portion 108 of the second end bracket 104 should be disposed to cover one of the apertures 34 in the side rail 16 of the first ladder section 12. The locking bushing 122 is then inserted into the aperture 34 from the outside so that the axial bore 32 aligns with the securing hole 120 in connecting arm portion 108 of the second end bracket 104. A push pin 190 in inserted through the axial bore 132 and securing hole 120. The counter bore 132 in the locking bushing 122 allows the flange cap 196 of the push pin 190 to be recessed into the locking bushing 122 as seen in FIG. 7.

Once the push pin 190 is inserted through the locking bushing 122, relative longitudinal movement between the first and second ladder sections 12 and 14 is prevented. To change the length of the ladder, the locking bushings 122 must first be removed from the apertures 34 in which they are confined, and reinserted into another aperture 34. This can only be accomplished by removing the push pin 190 securing the locking bushing 122 to the connecting arm 108 of the second end bracket 104.

Once the first and second ladder sections are assembled, the next step in the assembly process is to connect the feet assembly 140 to the lower end of the side rails 16 of the first ladder section 12. This is done by inserting the lower end of the side rails 16 between the legs 158 of the swivel connector 144 until the securing hole 21 in the side rails 16 align with the securing hole 162 and the swivel connector 144. The swivel connector is then secured to the side rail 16 by insertion of a push pin 190.

The final step in the assembly process is to connect the contact bar assembly 170 to the upper end of the second ladder section 14. This is done by sliding the sleeve portion 76 of the contact tube brackets 174 over the side rail 16 of the second ladder section 14. When the securing hole 180 in the contact tube support bracket 174 aligns with the securing holes 21 in the side rails 16, it is secured by the insertion of a push pin 190.

With trained personnel, the assembly of the ladder can be accomplished in approximately one minute. Also, the fully assembled ladder weighs only 57 pounds. It is apparent therefore that the present invention provides a lightweight, rapidly deployable ladder that can be broken down into individual components for storage The ladder 10 gives military and law enforcement personnel flexibility to adapt to changing circumstances giving them a greater edge over their adversaries.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A lightweight construction for a metal extension ladder (a) a first and second ladder section disposed adjacent one another with ends overlapping, each of which includes:

(1) a pair of spaced apart side rails comprising an elongated tubular member with a generally rectangular configuration and a structural web disposed within the tubular member for reducing flexure of the side rails:

(2) a series of apertures formed in the side rails at spaced intervals for reducing the weight of the side rails, said series of apertures extending substantially the entire length of the side rails;

(3) a plurality of rungs extending between and attached to said side rails;

(b) means for securing said first and second ladder sections together to allow for relative longitudinal movement between the first and second ladder sections;

(c) means for locking the first and second ladder sections to prevent relative longitudinal movement therebetween.

2. The metal extension ladder according to claim 1 wherein the securing means includes a pair of first end brackets attached to the side rails of the first ladder section, each first end bracket including means for engaging a respective side rail of the second ladder section so that relative longitudinal movement between the first and second ladder sections is permitted.

3. The metal extension ladder according to claim 2 wherein said first end bracket includes a sleeve portion adapted to slide over the side rails of the first ladder section and a retaining hook portion that extends from the sleeve portion around the side rail of the second ladder section so that the side rail of the second ladder section is confined between the retaining hook portion of the first end bracket of the rungs of the first ladder section.

4. The metal extension ladder according to claim 1 wherein said locking means comprises:

(a) a pair of second end brackets attached to the side rails of the second ladder section, each second end bracket including a sleeve portion insertable over the side rail of the second ladder section and a connecting arm portion extending from said sleeve portion; and (b) means attached to the side rails of the first ladder sections for releasably engaging the connecting arm portion of the second end bracket.

5. The metal extension ladder according to claim 4 wherein said engaging means comprises a generally cylindrical locking bushing adapted to be inserted into the apertures in the side rails of the first ladder section, the locking bushing including an axial bore extending therethrough; and wherein the connecting arm portion of the second end bracket includes a locking hole aligned with the axial bore in the locking bushing; said engaging means further including a locking pin insertable through the axial bore in the locking bushing, the locking pin including a locking end that projects from the axial bore in the locking bushing through the locking hole in the connecting arm portion of the second end bracket.

6. The metal extension ladder according to claim 1 wherein the rungs are pivotally attached to the side rails to allow the ladder to collapse into a folded condition.

7. The metal extension ladder according to claim 6 wherein adjacent rungs are attached to the side rails in different planes so that the ends of the rungs overlap when the ladder collapses into a folded condition.

8. The metal ladder according to claim 6 further including a locking bar pivotally secured at one end to one of the side rails and fastening means for securing the free end of locking bar to one of said rungs thereby securing the ladder section in an unfolded condition.

9. The metal ladder according to claim 1 further including a pair of foot assemblies releasably secured to the side rails of one of the first and second ladder sections.

10. The metal ladder according to claim 9 wherein each said foot assembly includes a base portion for engaging the ground, a swivel connector pivotally secured and one end to said base portion so as to pivot about at first axis, the swivel connector also being pivotally secured to the side rails of one of the first and second ladder sections, so as to pivot about a second axis, said first and second axes being perpendicular to one another.

11. The metal ladder according to claim 9 further including a contact bar assembly releasably secured to the side rails of one of the first and second ladder sections.

12. A lightweight construction for a metal ladder comprising:

(a) a pair of spaced apart side rails each of which includes an elongated tubular member having a generally rectangular configuration and a structural web disposed within the tubular member for stiffening the same against longitudinal deflection;

(b) a series of apertures formed in the side rails and extending substantially the entire length thereof for reducing the weight of said side rails, said series of apertures being arranged in groups with a space between each group; and (c) a plurality of longitudinally spaced rungs extending between the side rails, the rungs having two ends attached to respective side rails in the spaces formed between the groups of apertures.

13. The metal ladder according to claim 12 wherein said rungs are pivotally attached to said side rails so that the ladder collapses into a folded condition.

14. The metal ladder according to claim 13 wherein adjacent rungs are attached to the side rails in different planes so that the ends of the rungs overlap when the ladder collapses into a folded condition.

15. The metal ladder according to claim 14 further including a locking bar pivotally secured at one end to one of the side rails, and fastening means for securing the free end of the locking bar to one of the rungs thereby securing the ladder in an unfolded condition.

16. The metal ladder according to claim 12 further including a pair of foot assemblies releasably secured to the side rails of one of the first and second ladder sections.

17. The metal ladder according to claim 16 wherein each said foot assembly includes a base portion for engaging the ground, a swivel connector pivotally secured and one end to said base portion so as to pivot about at first axis, the swivel connector also being pivotally secured to the side rails of one of the first and second ladder sections, so as to pivot about a second axis, said first and second axes being perpendicular to one another.

18. The metal ladder according to claim 12 further including a contact bar assembly releasably secured to the side rails of one of the first and second ladder sections.

* * * * *